United States Patent [19]

Holst et al.

[11] 4,187,342

[45] Feb. 5, 1980

[54] BONDED FIBER WEB, WHICH IS CAPABLE OF ABSORBING WATER VAPOR COMPRISING A SWELLABLE CELLULOSE ETHER IN FIBER FORM

[75] Inventors: Arno Holst; Helmut Lask, both of Wiesbaden; Ehrenfried Nischwitz, Schmitten-Oberreifenbg.; Wilhelm Fischer, Pirmasens, all of Fed. Rep. of Germany

[73] Assignee: Hoechst Aktiengesellschaft, Fed. Rep. of Germany

[21] Appl. No.: 885,326

[22] Filed: Mar. 10, 1978

[30] Foreign Application Priority Data

Mar. 12, 1977 [DE] Fed. Rep. of Germany ..... 2710874

[51] Int. Cl.[2] ..... D04H 1/42; D04H 1/64; D06M 15/52; D06N 3/00

[52] U.S. Cl. ..... 428/283; 128/290 R; 128/296; 156/246; 427/356; 427/390 R; 427/421; 428/288; 428/297; 428/913

[58] Field of Search ..... 428/913, 283, 288, 297; 128/290 R, 296; 156/246; 427/356, 390, 421

[56] References Cited

U.S. PATENT DOCUMENTS

| | | | |
|---|---|---|---|
| 3,556,919 | 1/1971 | Johns et al. | 428/534 |
| 3,597,306 | 8/1971 | Mesek et al. | 428/283 |
| 3,965,091 | 6/1976 | Holst | 128/296 |
| 3,971,379 | 7/1976 | Chatterjel | 428/297 |
| 4,035,217 | 7/1977 | Kenette | 428/288 |
| 4,075,279 | 2/1978 | Holst et al. | 128/290 R |
| 4,096,289 | 6/1978 | Nischwitz et al. | 128/290 R |
| 4,100,324 | 7/1978 | Anderson et al. | 428/288 |

FOREIGN PATENT DOCUMENTS 2283255 3/1976 France .

*Primary Examiner*—J. C. Cannon
*Attorney, Agent, or Firm*—James E. Bryan

[57] ABSTRACT

This invention relates to a bonded fiber web capable of absorbing water vapor and composed of synthetic, natural or regenerated fibers with a uniformly incorporated additive of at least one polymer, said additive comprising fibrous particles of at least one swellable carbohydrate derivative or a swellable modified carbohydrate derivative. The invention also relates to a process for the manufacture of the bonded fiber web.

8 Claims, No Drawings

BONDED FIBER WEB, WHICH IS CAPABLE OF ABSORBING WATER VAPOR COMPRISING A SWELLABLE CELLULOSE ETHER IN FIBER FORM

This invention relates to a bonded fiber web having an improved capacity for absorbing water vapor, and to processes for the manufacture of these webs.

Webs of this type are of interest for various industrial fields of application; these include their uses as substitutes, above all, for leather or certain textiles in their fields of application, for example for shoes (shoe upper material, lining and soles), bag goods, upholstery covers, outer garments ("leather" and all-weather garments) or for textiles or domestic auxiliaries (tablecloths, window "leathers" and wiping cloths), as well as their combined or complementary uses with materials, such as leather or textiles, which can be used in these fields in addition to the webs. The use of bonded webs in these fields has been long known. For example, it is stated in the journal avr - Allgemeiner Vliesstoff Report 5, page 170/171 (1976), P. Keppler Verlag-Heusenstamm, about the use of webs and the demands made on webs in the shoe industry:

In contrast to, for example, fabrics, webs show particularly advantageous properties, which are similar to leather, with respect to the behavior on extension, the tear-propagation resistance, the stitch tear resistance, the resistance to pushing and the stability of their shape.

Although the known webs already have, as a rule, a good transmission of water vapor, their capacity for the absorption of water vapor is, however, partially as a function of the type of fiber materials processed, not yet sufficient for regarding the hygienic properties in wear under physiological conditions as being favorable.

Webs are particularly suitable as materials for inside backstraps and toe caps, as a carrier material for synthetic upper materials and as lining and reinforcing material.

When webs are thus employed under physiological conditions, one of the decisive demands on the material is that it not only transmits water vapor but is also capable of absorbing water vapor in order to provide, in particular, comfortable conditions in wear and to allow the body to breathe.

To obtain these required properties within certain ranges, essentially four processes are used:

1. Impregnation of fiber webs with solutions or dispersions of polymer, acting as binders, and subsequent coagulation of the polymers; it is intended that porous, breathing webs are obtained in this way. However, the capacity of such webs for absorbing water vapor is in most cases still inadequate.

2. Tailor-made use of certain starting materials for forming the binding polymer only within the web. The micro-porosity of webs bonded in this way is barely adjustable and can be achieved only under closely defined ratios of binder/fiber and, furthermore, the capacity of these webs for absorbing water vapor under physiological conditions is inadequate.

3. Applying the polymer, which acts as the binder, or certain prepolymers with the aid of a solvent and stripping off the solvent after or even during the period in which the reaction goes to completion. Stripping off the solvent provides the porosity by expanding the polymer, but the porosity is in most cases uneven and depends very strongly on the degree of consolidation of the polymer.

4. Finely dispersed substances, which can be dissolved out again, are evenly incorporated into the webs during the impregnation of the latter or during binding. These structures still must be treated in an involved way, in several working steps, with water or aqueous solutions and with heat.

A process for the manufacture of microporous fiber webs, bonded with polyurethane and, if appropriate, provided with a polyurethane top layer, is known from DT-AS No. 2,034,537, wherein reactive solutions of polyurethane-forming components, consisting of polyisocyanates, polyhydroxy compounds and chain extenders, are used and the solvent is removed by evaporation.

German Pat. No. 910,960, describes a process for the manufacture of porous, highly absorbent sheet-like structures, wherein webs of fibers which are capable of carding are subjected to a multi-stage impregnation, for example a two-stage or three-stage impregnation, with an aqueous dispersion or emulsion of film-forming vulcanizable bonding agents. During the final impregnation, or during two or more impregnations, finely dispersed substances which can be dissolved out again are incorporated in the structures in uniform distribution, the structures are in each case subjected to subsequent heat treatment, and finally treated with water or aqueous solutions. The following substances are listed as being suitable for use within the scope of this German Patent: water-soluble starch, water-soluble protein substances or protein-containing substances, sugar, tragacanth, water-soluble cellulose derivatives and water-soluble synthetic resins.

DT-OS No. 2,326,102, discloses a mixed fiber containing a base composition of regenerated cellulose as the predominant part of the fiber composition; the base composition contains a salt of a carboxyethylated starch in fine dispersion, and it is intended that it can be incorporated into a woven or non-woven absorbing cushion or into a tampon. These fibers are manufactured by allowing an agent which forms carboxyalkyl ethers (for example acrylonitrile) with starch in an alkaline medium, mixing the alkaline carboxyethylated starch with viscose, shaping the mixture into a fiber, coagulating the latter, and regenerating.

DT-OS No. 2,441,781, describes a process for improving the water absorption and the absorbence of fiber materials consisting of, or containing, fibers or filaments. In this process, modified, highly absorbent cellulose ethers are fixed on the fiber materials with the aid of finishing agents, high-grade finishing agents, resins or binders. The modified cellulose ethers are applied, together with the agents used for fixing them on the fiber material, to the latter from aqueous preparations, such as solutions, dispersions or emulsions. Preferentially, a cellulose ether, modified with N-methylolacrylamide, is used in an amount of about 0.1 to 5%, relative to the weight of the goods, of cellulose ether.

DT-OS No. 2,364,628, discloses a structure, rendered hydrophilic, of a fiber-forming and film-forming water-insoluble polymer, which contains particles of modified cellulose ethers, the mere degree of etherification of which would lead to water-soluble cellulose ethers and which are modified in such a way that, at least for the major part, they have become water-insoluble but have remained capable of absorbing water. These structures which have been rendered hydrophilic are to be understood, in particular, as films but also as filaments, provided they are produced by a customary precipitation process, for example, from regenerated cellulose. The pulverulent or grainy material consisting of the modified cellulose ethers is to be added to the polymer composition before shaping and is to be uniformly distributed therein.

It is the object of the invention to provide a bonded fiber web which is capable of absorbing water vapor and transmits water vapor and which is improved in comparison with the state of the art and can be manufactured in a simple manner.

The starting point of the invention is a bonded fiber web consisting of synthetic, natural or regenerated fibers together with a uniformly incorporated additive of polymers. The fiber web according to the invention comprises, as the additive, fibrous particles consisting of at least one swellable carbohydrate derivative or a swellable modified carbohydrate derivative. The term swellable is here to be unsderstood as the characteristic that the substances swell in aqueous fluids, in particular fluids with more than 50% by weight of water content, or that they swell as a result of water molecules (for example water vapor) coming into contact with them in another way. The term "uniformly incorporated" is to be understood as a statistical distribution.

In a preferred embodiment, the fiber web according to the invention comprises about 3 to 70% by weight, in particular 10 to 30% by weight, of additive, relative to the total fiber proportion, and the swellable carbohydrate derivative or swellable modified carbohydrate derivative is insoluble in water to the extent of at least about 30% by weight, in particular to the extent of at least about 50% by weight.

The following, for example, can be used within the scope of the invention as swellable carbohydrate derivatives or swellable modified carbohydrate derivatives: alkali metal salts of carboxymethyl cellulose, which are heat-treated and are swellable in water, according to U.S. Pat. No. 2,639,239; in the process for the manufacture of this product, the solubility of a water-soluble alkali metal salt of carboxymethylcellulose having a D.S. (=degree of substitution, i.e., the number of substituted hydroxyl groups on one anhydro-D-glucose unit) of 0.5 up to about 1 is reduced by subjecting this dry salt, in the finely divided form to a temperature of about 130° to about 210° C., highly swellable gel particles being obtained.

Water-insoluble, heat-treated carboxyalkyl celluloses, which absorb and retain liquids, according to U.S. Pat. No. 3,723,413 (=DT-OS No. 2,314,689); in the process for the manufacture of these products the procedure is that (a) cellulose materials are treated with carboxyalkylating reactants and in this way water-soluble carboxyalkyl cellulose is formed which has an average degree of substitution of more than 0.35 carboxyalkyl radicals per anhydroglucose unit in the cellulose but which possesses poor properties with respect to the absorption and retention of liquids, (b) such a proportion of the carboxyalkylating reactants and the by-products formed during the reaction is removed that, relative to the weight of the water-soluble carboxyalkyl cellulose, at least about 3% by weight thereof remain and (c) the carboxyalkyl cellulose is subjected to a heat treatment in the presence of the remaining carboxyalkylating reactants and by-products of the reaction and, thus, is rendered water-insoluble, and excellent properties with respect to the absorption and retention of liquids are imparted to the carboxyalkyl cellulose.

Absorbent carboxymethyl cellulose fibers which are suitable for use in fiber materials for absorbing and retaining aqueous solutions and are substantially water-insoluble, according to U.S. Pat. No. 3,589,364 (=DT-OS No. 1,912,740); fibers of this type consist of wet-crosslinked fibers of water-soluble salts of carboxymethyl cellulose having a D.S. of about 0.4 to 1.6 and possess the original fiber structure. Preferably, about 3–10% by weight of epichlorohydrin is employed as the crosslinking agent.

Chemically crosslinked, swellable cellulose ethers, according to U.S. Pat. No. 3,936,441 (=DT-OS No. 2,357,079); these crosslinked cellulose ethers, in particular those obtained from carboxymethyl cellulose, carboxymethyl hydroxyethylcellulose, hydroxyethylcellulose, or methylhydroxyethylcellulose, are manufactured by reacting the ethers, which in themselves are water-soluble, in an alkaline reaction medium with a crosslinking agent, the functional groups of which are the acrylamido group $CH_2{=}CH{-}\underset{\underset{|O|}{\|}}{C}{-}\bar{N}{-}$ the chloro-azamethine group $-\bar{N}{=}\underset{\underset{|Cl|}{|}}{C}{-}$ or the allyloxy-azomethine group $-\bar{N}{=}\underset{|}{C}{-}\bar{O}{-}CH_2{-}CH{=}CH_2$ or which is dichloroacetic acid or phosphorus oxychloride.

Chemically modified, swellable cellulose ethers, according to U.S. Pat. No. 3,965,091, (=DT-OS No. 2,358,150); these cellulose ethers which have not been modified by crosslinking are manufactured by reacting the ethers, which in themselves are water-soluble, in an alkaline reaction medium with a monofunctionally reacting compound which is described by one of the two general formulae which follow:

$$CH_2{=}CH{-}CO{-}NH{-}\underset{\underset{R_2}{|}}{CH}{-}R_1 \quad \text{or} \qquad \text{I}$$

$$CH_2{=}CH{-}SO_2{-}NH_2, \qquad \text{II}$$

wherein $R_1$ in formula I denotes the hydroxy group, an acylamino group or an esterified carbamino group and $R_2$ denotes hydrogen or the carboxyl group.

Chemically crosslinked, swellable cellulose ethers, according to DT-OS No. 2,519,927; these crosslinked cellulose ethers are manufactured by reacting the ethers, which in themselves are water-soluble, in an alkaline reaction medium with bis-acrylamidoacetic acid as the crosslinking agent.

Water-insoluble carboxymethyl celluloses, such as are used in German Pat. No. 1,079,796, and DT-AS No. 1,151,474, i.e., those which have a D.S. of 0.05 to 0.3 and those which are substantially water-insoluble and also have a low D.S.

Water-insoluble, more highly polymerized carboxymethyl cellulose or carboxyethyl cellulose with a significant content of free carboxyl groups, according to British Pat. No. 725,887 (=German Pat. No. 1,037,076), which are rendered water-insoluble by heating the water-soluble acid compounds to 80° C. to 177° C.

Phosphorylated cellulose fibers, according to DT-OS No. 2,447,282, such as can be produced by a reaction of cellulose pulp with urea and phosphoric acid under the action of heat, a subsequent acid hydrolysis, and ultimately a conversion into the form of a salt.

Cellulose graft polymers, according to DT-OS No. 2,516,380, which are manufactured by grafting side-chains of those polymer radicals onto the cellulose which are selected from the ionic and non-ionic polymer radicals. For example, polyacrylic acid, sodium polyacrylate, polymethacrylic acid, potassium polymethacrylate, polyvinyl alcohol sulfate, polyphosphoric acid, polyvinylamine, poly-(4-vinylpyridine), hydrolyzed polyacrylonitrile, polymethyl methacrylate, polyvinyl acetate, polystyrene or polybutadiene are suitable for this purpose.

Modified cellulose material, having an improved retention capacity both for water and physiological fluids, according to DT-OS No. 2,528,555, which is manufactured by grafting an olefinically unsaturated, polymerizable monomer with hydrolyzable functional groups or a monomer carrying functional carboxyl groups onto a fibrous cellulose material and hydrolyzing the grafted product or treating the latter with alkali in other ways. In this process, the product is first converted to the state of maximum swelling, is then acidified to a pH value at which it is in the state of minimum swelling, is then converted to the form of a salt under conditions which do not effect swelling and is finally dried.

Among the swellable carbohydrate derivatives or swellable modified carbohydrate derivatives, which have been listed, the derivatives of cellulose are preferred and, among the latter, cellulose ethers which have been modified by crosslinking, effected with the aid of heat energy, radiation or by an additional chemical compound, are particularly preferred. With particular advantage, the crosslinked cellulose ethers are here manufactured from a rayon staple fiber which is crosslinked before, simultaneously with, or after the etherification. Within the scope of the present invention, rayon staple fibers are to be understood as fibers which are composed of regenerated cellulose (for example viscose, i.e., fibers manufactured from cellulose sodium xanthate) and which have been cut as uniformly as possible by mechanical cutting and the length of which is in the range from about 30 mm to 150 mm, in particular about 30 mm to 60 mm.

The processes for the manufacture of webs and also for the bonding thereof to achieve good dimensional stability and strength are known. Methods which may be mentioned for the manufacture of webs concern carded webs, webs obtained by a pneumatic route, spun webs or webs which are manufactured by wet laying, for example on a paper machine. The main constituent of the webs according to the invention are synthetic, natural or regenerated fibers, in particular fibers of polyester, polyamide, polyacrylonitrile, polyvinyl chloride, polyvinyl acetate, polyvinyl alcohol, cotton, rayon staple fiber, collagen, polyurethane or mixtures thereof. The fibrous particles, advantageously of a length in the range from about 5 to about 200 mm, of at least one of the above-mentioned carbohydrate derivatives or modified carbohydrate derivatives are added to these fibers before or during the manufacture of the web, and are uniformly incorporated therein. The bonding of the fiber web, for example, can be carried out by one of the following processes:

Impregnation of the unbonded fiber web with film-forming bonding agents and subsequent consolidation of the impregnating substance; for this purpose, synthetic latex, polyurethane from an aqueous solution or in an organic solvent or polyurethane precursors are used in most cases. The polyurethane is here produced, for example, either in a one-stage process directly from the reactants: compounds containing NCO groups, compounds containing OH groups and chain extenders, or the polyurethane is produced in a two-stage process by first preparing so-called prepolymers from diisocyanates and polyisocyanates on the one hand and the reactant which reacts more slowly (for example the compounds containing OH groups) on the other hand and subsequently allowing the prepolymer to react with the reactant which reacts faster (for example the chain extender containing $NH_2$ groups).

Likewise, a process which is used especially also in the manufacture of bonded webs which are to be provided with a top layer (synthetic leather), is also possible. In this process, a thin film (or several thin films), for example of polyurethane and/or polyacrylate, is applied to a matrix, for example a release paper, a coated carrier, a steel tape or a silicone rubber matrix and the web, which in general is still unbonded, is placed upon the topmost layer which has not yet fully reacted. If the production of one or more top layers is to be omitted, the unbonded web is placed directly upon the matrix. Subsequently a reactive solution, for example a solution of the components of the manufacture of polyurethane (see preceding paragraph) is applied to the web by a coating knife, by spraying or by casting and, if appropriate, is rolled in, the solvent is evaporated and the finished bonded web or the finished synthetic leather is released from the matrix.

In carrying out the examples, the procedure followed was, in particular, in accordance with the three processes described in the following text (parts are parts by weight):

1.1 The fibers of the swellable carbohydrate derivative or swellable modified carbohydrate derivative, which fibers are to be employed as the additive, are pre-carded for good opening-up and are mixed in a certain ratio with the synthetic, natural or regenerated fibers (in particular polyester fibers or rayon staple fibers) by passing them once or several times through a tearing machine. The fiber mixture is processed by means of carding machines and leasing machines to give a web which has a weight per unit area of about 150 $g/m^2$ and which is slightly consolidated mechanically in a preliminary needle-punching loom. It is also possible-if required-to needle-punch together several plies of this web in a twin needle-punching loom, for example to give a web having a weight per unit area of about 370 $g/m^2$.

1.2 The needle-punched web is then bonded with synthetic latex, for example by dip-impregnation on the padder with the following components:

200 parts of a 60% by weight aqueous dispersion of a copolymer of butadiene, acrylonitrile and methacrylic acid (for example Perbunan-N-Latex ®), 0.5 part of a functional organosilicon compound (for example Coagulant ® WS), 10 parts of alkylaryl polyglycol ether (for example Emulvin ® W), 0:25 part of silicone antifoam (for example Nopco ® 8034), 40 parts of a vulcanization paste composed of zinc oxide, colloidal sulfur and zinc dithiocarbamate, and 10 parts of a brown leather dyestuff.

The impregnated web is dried for about 40 minutes at about 100° C., and the binder content is about 90 to 110% by weight, relative to the total proportion of fibers.

2.1 as 1.1.

2.2 The needle-punched web is bonded with an aqueous medium containing polyurethane, for example by dip-impregnation on the padder with the following components:

50 parts of an aqueous polyurethane dispersion (for example Acralen UKA ® 8153), 2 parts of an anionic emulsifier (for example Emulsifier ® KA 9024), 2 parts of a non-ionic emulsifier (for example an alkylaryl polyglycol ether, such as Emulvin ® W), 8 parts of aqueous 3% by weight $Ca(NO_3)_2$ solution, and 2.5 parts of a brown leather dyestuff.

The impregnated web is dried for about 50 minutes at about 110° C. and the binder content is about 70 to 100% by weight, relative to the total proportion of fibers.

3.1 as 1.1

3.2 The needle-punched web is bonded with a 9% by weight solution of a polyurethane in DMF (=dimethylformamide), for example by dip-impregnation on the padder, and is subsequently coagulated in a mixture of 85 parts of water and 15 parts of DMF. After the coagulation, the impregnated web is rinsed with water and dried for about 45 minutes at about 100° C. The binder content is about 70 to 85% by weight, relative to the total proportion of fibers.

The trademarks mentioned belong to Bayer AG, Leverkusen.

Thus, for the manufacture of the bonded web according to the invention, the binder(s) is or are added, for example by dip-impregnation or by treatment on a matrix, to the base composition, which is to be bonded, of the fiber web composed of synthetic, natural or regenerated fibers and to the additive of fibrous particles composed of at least one swellable carbohydrate derivative or swellable modified carbohydrate derivative.

If the bonded webs according to the invention are to be employed, in particular, in the fields of application in the shoe industry sector, for example as a carrier material for synthetic uppers, the coating can be carried out in one working step together with the bonding of the web—in particular by the process, which has been described above, of applying the coating agent and/or binder to a matrix—or the web can be coated after it already has been bonded; these coating processes are generally known and are described, for example, in Kunststoffhandbuch (Plastics Handbook), Volume VII, "Polyurethane", by R. Vieweg and A. Höchtlen, Carl Hanser Verlag, Munich (1966) or Volume II (parts 1 and 2), "Polyvinyl Chloride", by K. Krekeler and G. Wick, Carl Hanser Verlag, Munich (1963).

The webs according to the invention have a high capacity for the absorption of water vapor and the transmission of water vapor, which far exceeds a mere transport effect by the incorporated fibrous particles. Furthermore, the webs are also able to release the absorbed water vapor again under certain conditions, for example when placed under different climatic conditions.

Because the properties of the bonded web are not alone the result of the significantly detectable effect of the addition of the fibrous particles of at least one swellable carbohydrate derivative or swellable modified carbohydrate derivative, but also depends, inter alia, on the thickness of the web, the webs advantageously are prepared in a thickness of about 0.1 to 5 mm or are split down to this thickness.

The bonded webs according to the invention, having the stated properties, are suitable, for example, for use as a self-supporting web (for example as a shoe lining or insole) or as a carrier for coatings with synthetic materials for use as shoe upper material, upholstery covers, bag goods and outer garments ("leather" garments and all-weather garments), and in particular as a carrier for coatings to produce a synthetic leather.

The parameters used in the description and in the Examples for describing the webs according to the invention and the swellable carbohydrate derivatives or swellable modified carbohydrate derivatives (simply called polymer in the following text) present therein, are to be understood as meaning the following:

WRV Water retention capacity of the swellable modified polymer in % by weight, measured against 2,000 times the acceleration due to gravity, relative to its water-insoluble fraction; WRV is determined after immersing the sample in water.

WUA Water-insoluble fraction in the swellable modified polymer.

DA Degree of substitution, i.e., the number of substituted hydroxyl groups on the anhydro-D-glucose units, from 0.0 to 3.0.

SV Absorbency of the swellable modified polymer for a 1% NaCl solution in % by weight, relative to its total weight; SV is determined after 1% aqueous NaCl solution has been absorbed by the sample up to saturation.

WDA The water vapor absorption is determined as the weight loss of a sample dried to constant weight, relative to the original weight, under the conditions according to DIN 53,304 (May 1968 edition) at 102° C.±2° C. In this method, the sample is first weighed, in the state as delivered, to an accuracy of 0.001 g, immediately after it has been removed from a water vapor-tight container. The test specimens are then dried, suspended in a heating cabinet, at 102° C.±2° C. for 15 hours and, after cooling to room temperature, are likewise weighed to an accuracy of 0.001 g. In order to be able thoroughly to test the capacity of samples for the absorption of water vapor under different conditions, the particular samples are suspended in different climatic conditions and these samples are taken out after certain time intervals and their absorption of water vapor is then determined in % by weight, relative to their initial weight at the start of the particular measurement.

Flexural strength Measurement of the permanent flexural strength of light-weight leathers and their top layers (I.U.P./20 of the Internationale Union der Leder-Chemiker-Verbände (International Union of Associations of Leather Chemists), see "Das Leder (Leather)", E. Roether-Verlag, Darmstadt, 15 87 (1964) and 26, 163 (1969) ). The leather sample is folded and, in this state, its two ends are clamped into the test instrument. One clamp is stationary and the other moves to and fro, so that the fold moves up and down along the leather sample. The leather sample is tested at intervals in order to establish whether damage has occurred thereon. The test can be carried out on dry samples, conditioned samples or samples which have been moistened in a certain way. The dry experiment is intended to test the leather and its finishing. The wet experiment solely serves to assess the finishing.

Tensile strength Measurement of the tensile strength in a tensile test (according to DIN 53,328 of December 1970, which factually agrees with the I.U.P./6 process of the Internationale Union der Leder-Chemiker-Verbände (International Union of Associations of Leather Chemists), see "Das Leder (Leather)", E. Roether-Verlag Darmstadt, 10, 14 (1959)). The tensile strength $\sigma_B$ is the quotient of the measured maximum force in daN and the initial cross-section of the sample in $cm^2$.

Elongation The measurement of the elongation at break, i.e., $\delta_R$ in %, relative to the initial measured length, is calculated as follows:

$$\delta_r = \frac{L_b - L_o}{L_o} \cdot 100\%$$

(according to DIN 53,328, $L_B$=measured length of the sample in mm at break, $L_o$=initial measured length).

Tear propagation resistance and stitch tear resistance These values are measured according to DIN 53,329 of February 1944; the forces for the tear propagation or tearing of incisions are determined in this method.

EXAMPLE 1

This Example and the following Example first describe the preparation of the swellable etherified and cross-linked rayon staple fibers which are preferentially used within the scope of the invention.

60 parts by weight of a rayon staple fiber (1.7 dtex, 40 mm long) are added to a homogenized mixture of 22.35 parts by weight of 50% by weight aqueous NaOH solution and 819 parts by weight of 87% by weight aqueous isopropanol in a reactor having a solvent circulation unit. After switching on the circulation unit, the stationary flock is alkalized for about 30 minutes at about 20° to 25° C. with continuous flow through the flock. A part of the liquid mixture is withdrawn from the reactor and used for the preparation of the etherification/cross-linking mixture which is composed of 24.42 parts by weight of Na monochloroacetate and 0.7 part by weight of bisacrylamido-acetic acid. The mixture is returned into the reactor, the entire reactor contents are heated up to about 70° C. and the etherification and crosslinking are carried out for one hour at this temperature. The reaction product is neutralized with hydrochloric acid and filtered and the solid residue is washed with 70% by weight aqueous methanol, until free from salt. The fiber material dried at about 60° C. has the following characteristics: WRV=1,100, WUA=68, SV=1,330 and DS=0.22.

EXAMPLE 2

The reaction is carried out in accordance with the procedure of Example 1, but using 20.4 parts by weight of a 50% by weight aqueous NaOH solution, 650 parts by weight of 87% by weight aqueous isopropanol, 44 parts by weight of a rayon staple fiber moistened with water (1.7 dtex, 40 mm long, 45.4% solids content of the fiber moistened with water), 13.7 parts by weight of 80% by weight aqueous monochloroacetic acid solution and 0.233 part by weight of bisacrylamidoacetic acid. The fiber material has the following characteristics: WRV=4,600, WUA=71, SV=1,510 and DS=0.36.

Examples 3 to 6 and Comparative Examples V1 and V2

The following webs are prepared from rayon staple fiber (viscose, 1.7 dtex, 40 mm long) or polyester staple fiber (polyethylene glycol terephthalate, 1.3 dtex, 38 mm) and with or without (for comparison) one of the fibrous swellable modified cellulose ethers prepared according to Examples 1 or 2 from rayon staple fiber:

V1
Web from 100% by weight of rayon staple fiber

Example 3
Web from 95% by weight of rayon staple fiber and 5% by weight of fibrous swellable crosslinked cellulose ether V2
Web from 100% by weight of polyester staple fiber Example 4
Web from 95% by weight of polyester staple fiber and 5% by weight of fibrous swellable crosslinked cellulose ether Example 5
Web from 85% by weight of polyester staple fiber and 15% by weight of fibrous swellable crosslinked cellulose ether Example 6
Web from 70% by weight of polyester staple fiber and 30% by weight of fibrous swellable crosslinked cellulose ether.

The webs are bonded, according to one of the methods (1 to 3) indicated in the description, with latex (a dispersion of a copolymer of butadiene, acrylonitrile and methacrylic acid) or with a polyurethane by dip-impregnation and drying of the impregnated and, if appropriate, coagulated web.

Examples 7 and 8 (see Table I)

The tensile strength, elongation, tear propagation resistance and stitch tear resistance of the following webs are determined in the directions a and b, these directions differing in that their directional axes enclose an angle of 90°.

Example 7:
Web composed of 85% by weight of polyester staple fiber and 15% by weight of fibrous swellable crosslinked cellulose ether (prepared according to Example 1); bonded with polyurethane, binder proportion: 83.6% by weight, relative to the total fiber proportion of the bonded web.

Example 8:
Web composed of 70% by weight of polyester staple fiber and 30% by weight of fibrous swellable crosslinked cellulose ether (prepared according to Example 2), bonded with polyurethane, binder proportion: 71.4% by weight, relative to the total fiber proportion of the bonded web.

The physical data for the strength are not affected, or only insignificantly affected, by the addition of specially modified swellable fibers to the web (see measured values in Table I). This is also shown by the measurement of the flexural strength; the two webs do not yet show any cracks or other mechanical damage after 150,000 folds at +20° C. and after 30,000 folds at −10° C.

Examples 9 and 10 and comparative Examples V3 and V4

Webs according to the invention are prepared and compared with samples of calf velour (V3) and split leather (V4).

Example 9

Web composed of 85% by weight of polyester staple fiber and 15% by weight of fibrous swellable crosslinked cellulose ether (prepared according to Example 1), bonded with synthetic latex, binder proportion: 109.6% by weight, relative to the total fiber proportion of the bonded web.

Example 10

Web composed of 70% by weight of polyester staple fiber and 30% by weight of fibrous swellable crosslinked cellulose ether (prepared according to Example 1), bonded with synthetic latex, binder proportion: 105.3% by weight, relative to the total fiber proportion of the bonded web.

The webs and the comparative samples are exposed to a humidity of 65% relative humidity at 20° C. and then exposed to various other humidities (20% relative humidity, 35% relative humidity and 95% relative humidity) at 20° C., and the increase or decrease in moisture is measured in each case after a certain length of time (see WDA further above). Particularly in the case of high humidities, the webs according to the invention give good WDA values, as compared with the natural product leather (see Table II).

Examples 11 to 14 and Comparative Examples V2 to V4

Webs according to the invention are prepared and compared with samples of a commercially available web (V2) which is unmodified and has been bonded with latex, calf velour (V3) and split leather (V4).

Example 11

See Example 9.

Example 12

See Example 10.

Example 13

Web composed of 85% by weight of polyester staple fiber and 15% by weight of fibrous swellable crosslinked cellulose ether (prepared according to Example 2), bonded with polyurethane, binder proportion: 83.6% by weight, relative to the total fiber proportion of the bonded web.

Example 14

Web composed of 70% by weight of polyester staple fiber and 30% by weight of fibrous swellable crosslinked cellulose ether (prepared according to Example 2), bonded with polyurethane, binder proportion: 72.6% by weight, relative to the total fiber proportion of the bonded web.

The webs and the comparative samples are first weighed in the dry state and then exposed to various humidities (20% relative humidity, 35% relative humidity, 65% relative humidity and 95% relative humidity) at 20° C. and the moisture content (as WDA) is measured in each case after a certain length of time (see Table III). Compared with the unmodified web, the webs according to the invention show a markedly improved water vapor absorption.

Examples 15 to 18 and Comparative Examples V2 to V4

Webs according to the invention are prepared and compared with samples of a commercially available web (V2) which is unmodified and has been bonded with polyurethane, calf velour (V3) and split leather (V4):

Example 15

See web according to Example 9.

Example 16

See web according to Example 10.

Example 17

See web according to Example 13.

Example 18

See web according to Example 14.

The webs and the comparative samples are removed from climatic conditions of 65% relative humidity and 20° C. (they had been pre-dried overnight at 100° C. before being left in these climatic conditions) and are exposed to climatic conditions of 95% relative humidity and 20° C., and the moisture content (as WDA) is measured in each case after a certain length of time (see Table IV). The Examples provided with an asterisk differ from the others in that the storage under climatic conditions is carried out after several hours' storage under ambient climatic conditions, and not after several hours' storage at about 100° C.

Example 19 and Comparative Examples V2 and V3

A web composed of 70% by weight of polyester staple fiber and 30% by weight of fibrous swellable crosslinked cellulose ether (prepared according to Example 2) is bonded with latex; binder proportion: 105.3% by weight, relative to the total fiber proportion of the bonded web; the web according to the invention is compared with samples of a commercially available web (V2) which is unmodified and has been bonded with latex, and calf velour (V3). For this purpose, the samples are predried in a drying cabinet at 120° C. for ½ hour or 1 hour and are then exposed to climatic conditions of 95% relative humidity and 20° C., and the moisture content (as WDA) is measured in each case after a certain length of time (see Table V).

Examples 20 and 21 and Comparative Examples V2 and V3

Webs according to the invention are prepared and compared with samples of a commercially available web (V2) which is unmodified and has been bonded with latex, and calf velour (V3).

| | |
|---|---|
| Example 20 See web according to Example 9<br>Example 21 See web according to Example 10 | but in each case with a cellulose ether which was prepared according to Example 2. |

The webs and the comparative samples are in part (see Table VI) pretreated in three ways, namely stored for 1 week at 65% relative humidity and 20° C. or additionally pretreated by heat for ½ hour or 1 hour at 120° C. The pretreatment by heat results in all cases (i.e., also in the comparative Examples) in a reduced water vapor absorption which possibly may be ascribed to structural changes in the web or leather.

TABLE I

| Example | Tensile strength $\sigma_B$ (daN/cm$^2$) direction a | Tensile strength $\sigma_B$ (daN/cm$^2$) direction b | Elongation in % direction a | Elongation in % direction b | Tear-propagation resistance (daN) direction a | Tear-propagation resistance (daN) direction b | Stitch tear resistance (daN) direction a | Stitch tear resistance (daN) direction b |
|---|---|---|---|---|---|---|---|---|
| 7 | 24.1 | 20.7 | 60 | 57 | 11.2 | 14.3 | 14.6 | 15.2 |
| 8 | 22.4 | 16.4 | 55 | 53 | 9.6 | 9.2 | 12.0 | 11.1 |

TABLE II

| Example | Thickness of the sample (mm) | Surface area of the sample (mm$^2$) | Duration of measurement (hours) | WDA (% by weight) at 65% relative humidity/20° C. | Increase or decrease (% by weight) in WDA at 20% relative humidity/20° C. | 35% relative humidity/20° C. | 95% relative humidity/20° C. |
|---|---|---|---|---|---|---|---|
| V3 | 1.30 | 50–100 | 4 | | −2.25 | −1.75 | +6.39 |
| | | | 8 | | −2.61 | −2.01 | +7.94 |
| | | | 24 | 15.26 | −2.84 | −2.21 | +12.74 |
| V4 | 1.90 | " | 4 | | −2.53 | −2.14 | +7.18 |
| | | | 8 | | −3.01 | −2.48 | +9.11 |
| | | | 24 | 17.02 | −3.37 | −2.71 | +13.40 |
| 9 | 1.15 | " | 4 | | −0.56 | −0.39 | +6.28 |
| | | | 8 | | −0.58 | −0.42 | +6.80 |
| | | | 24 | 2.14 | −0.60 | −0.42 | +11.37 |
| 10 | 1.05 | " | 4 | | −1.30 | −0.94 | +8.29 |
| | | | 8 | | −1.36 | −0.94 | +9.22 |
| | | | 24 | 3.40 | −1.40 | −0.95 | +13.61 |

TABLE III

| Example | Thickness of the sample (mm) | Surface area of the sample (mm$^2$) | Duration of measurement (hours) | WDA (% by weight) at 20° C. and 20% relative humidity | 35% relative humidity | 65% relative humidity | 95% relative humidity |
|---|---|---|---|---|---|---|---|
| V3 | 1.30 | 50–100 | 4 | 4.84 | 6.88 | 12.48 | 20.79 |
| | | | 8 | 7.94 | 7.36 | 12.98 | 24.28 |
| | | | 24 | 5.53 | 7.80 | 14.05 | 32.24 |
| | | | 48 | 5.68 | 7.94 | 14.11 | 36.19 |
| | | | 72 | 5.79 | 8.07 | 14.16 | 37.56 |
| V4 | 1.90 | " | 4 | 5.49 | 7.67 | 13.36 | 21.93 |
| | | | 8 | 5.97 | 8.27 | 14.29 | 26.21 |
| | | | 24 | 6.39 | 8.84 | 15.46 | 34.90 |
| | | | 48 | 6.56 | 8.98 | 15.64 | 37.96 |
| | | | 72 | 6.68 | 9.09 | 15.52 | 39.96 |
| V2 | 1.05 | " | 4 | 0.29 | 0.54 | 1.15 | 2.16 |
| | | | 8 | 0.34 | 0.57 | 1.12 | 2.61 |
| | | | 24 | 0.37 | 0.59 | 1.19 | 4.73 |
| | | | 48 | 0.37 | 0.59 | 1.26 | 5.73 |
| | | | 72 | 0.39 | 0.63 | 1.21 | 5.88 |
| 11 | 1.15 | " | 4 | 0.58 | 1.79 | 1.66 | 4.29 |
| | | | 8 | 0.65 | 1.84 | 1.64 | 5.58 |
| | | | 24 | 0.69 | 1.88 | 1.74 | 11.02 |
| | | | 48 | 0.72 | 1.88 | 1.74 | 14.57 |
| | | | 72 | 0.74 | 1.92 | 1.71 | 16.13 |
| 12 | 1.05 | " | 4 | 0.97 | 1.22 | 2.63 | 5.80 |
| | | | 8 | 1.03 | 1.30 | 2.74 | 7.81 |
| | | | 24 | 1.08 | 1.36 | 2.83 | 15.79 |
| | | | 48 | 1.11 | 1.36 | 2.84 | 19.70 |
| | | | 72 | 1.15 | 1.40 | 2.77 | 20.51 |
| 13 | 2.65 | 50–100 | 4 | 0.68 | 0.85 | 1.61 | 2.79 |
| | | | 8 | 0.73 | 0.92 | 1.62 | 3.51 |
| | | | 24 | 0.76 | 0.95 | 1.72 | 5.98 |
| | | | 48 | 0.77 | 0.94 | 1.74 | 7.50 |
| | | | 72 | 0.78 | 0.99 | 1.70 | 7.45 |
| 14 | 2.45 | " | 4 | 1.09 | 1.45 | 2.53 | 4.37 |
| | | | 8 | 1.16 | 1.54 | 2.62 | 5.60 |
| | | | 24 | 1.18 | 1.61 | 2.70 | 9.56 |
| | | | 48 | 1.21 | 1.61 | 2.72 | 11.81 |
| | | | 72 | 1.23 | 1.65 | 2.69 | 13.41 |

TABLE IV

| Ex. | Thickness of the sample (mm) | Surface area of the sample (mm$^2$) | WDA (% by weight) at 20° C. after 4 hours | 8 hours | 24 hours | 48 hours |
|---|---|---|---|---|---|---|
| V3 | 1.30 | 50–100 | 7.11 | 8.42 | 14.00 | 18.36 |

TABLE IV-continued

| Ex. | Thickness of the sample (mm) | Surface area of the sample (mm$^2$) | WDA (% by weight) at 20° C. after 4 hours | 8 hours | 24 hours | 48 hours |
|---|---|---|---|---|---|---|
| V4 | 1.90 | " | 7.27 | 9.02 | 14.07 | 18.86 |

TABLE IV-continued

| Ex. | Thickness of the sample (mm) | Surface area of the sample ($mm^2$) | WDA (% by weight) at 20° C. after 4 hours | 8 hours | 24 hours | 48 hours |
|---|---|---|---|---|---|---|
| V2 | 1.05 | " | 1.06 | 1.06 | 2.79 | 3.98 |
| 15 | 1.15 | " | 3.04 | 3.05 | 6.08 | 10.61 |
| 16 | 1.05 | " | 3.86 | 4.56 | 7.99 | 13.26 |
| 17 | 2.65 | " | 1.00 | 0.78 | 2.52 | 4.61 |
| 18 | 2.45 | " | 2.58 | 2.68 | 4.48 | 6.78 |
| V3* | 1.30 | " | — | — | 16.39 | 18.63 |
| V2* | 1.05 | " | — | — | 4.58 | 4.96 |
| 16* | 1.05 | " | — | — | 16.71 | 20.47 |

*See description of the Examples

TABLE V

| Example | Thickness of the sample (mm) | Surface area of the sample ($mm^2$) | WDA (% by weight) at 95% relative humidity/20° C. after predrying for ½ hour: 4 hours | 8 hours | 12 hours | after predrying for 1 hour: 4 hours | 8 hours | 12 hours |
|---|---|---|---|---|---|---|---|---|
| V3 | 1.30 | 50–100 | 19.99 | 23.44 | 24.90 | 19.90 | 23.56 | 24.95 |
| V2 | 1.05 | " | 2.25 | 2.28 | 2.40 | 1.59 | 2.51 | 2.85 |
| 19 | 1.05 | " | 5.12 | 5.32 | 6.47 | 3.97 | 5.97 | 7.23 |

TABLE VI

| Example | Thickness of the sample (mm) | Surface area of the sample ($mm^2$) | Duration of measurement (hours) | WDA (% by weight) with different pretreatment: without pretreatment by heat | with pretreatment by heat of ½ hour | of 1 hour |
|---|---|---|---|---|---|---|
| V3 | 1.30 | 50–100 | 4 | 9.70 | 4.59 | 5.09 |
| | | | 8 | 10.14 | 6.47 | 6.17 |
| | | | 12 | 11.06 | 7.34 | 7.45 |
| | | | 24 | 16.39 | — | — |
| V2 | 1.05 | " | 4 | 2.42 | 1.82 | 1.34 |
| | | | 8 | 2.38 | 1.92 | 2.17 |
| | | | 12 | 2.88 | 1.66 | 2.01 |
| | | | 24 | 4.58 | — | — |
| 20 | 1.05 | " | 4 | 6.05 | — | — |
| | | | 8 | 6.52 | — | — |
| | | | 12 | 8.58 | — | — |
| | | | 24 | 13.95 | — | — |
| 21 | 1.05 | " | 4 | 7.56 | 4.69 | 4.94 |
| | | | 8 | 7.99 | 5.30 | 4.57 |
| | | | 12 | 9.95 | 5.67 | 4.98 |
| | | | 24 | 16.71 | — | — |

It will be obvious to those skilled in the art that many modifications may be made within the scope of the present invention without departing from the spirit thereof, and the invention includes all such modifications.

What is claimed is:

1. In a bonded fiber web capable of absorbing water vapor and composed of synthetic, natural or regenerated fibers with an uniformly incorporated additive of at least one polymer, the improvement comprising about 3 to 70% by weight, relative to the total fiber proportion, of said additive which comprises fibrous particles of at least one swellable cellulose ether, which has been modified by crosslinking, effected by means of heat energy, radiation, or an additional chemical compound and which is insoluble in water to the extent of at least about 30% by weight.

2. A fiber web as claimed in claim 1 which comprises a crosslinked cellulose ether manufactured from rayon staple fiber.

3. A fiber web as claimed in claim 1, which includes about 10 to 30% by weight of said additive, relative to the total fiber proportion.

4. A fiber web as claimed in claim 1, in which said crosslinked cellulose ether is insoluble in water to the extent of at least about 50% by weight.

5. In the process for the manufacture of a bonded fiber web capable of absorbing water vapor and composed of synthetic, natural or regenerated fibers with an uniformly incorporated additive of at least one polymer, the improvement comprising (a) adding to the synthetic, natural or regenerated fibers, before or during the manufacture of the web, about 3 to 70% by weight, relative to the total fiber proportion, of fibrous particles of at least one swellable cellulose ether, which has been modified by crosslinking, effected by means of heat energy, radiation, or an additional chemical compound and which is insoluble in water to the extent of at least about 30% by weight, (b) incorporating said fibrous particles uniformly therein, (c) bonding the fiber web, and (d) drying it after bonding.

6. A process as claimed in claim 5 which comprises bonding the fiber web with synthetic latex or polyurethane.

7. A process as claimed in claim 5 which comprises dip-impregnating the fiber web in aqueous dispersions or solutions of a binder, which may contain an organic solvent.

8. A process as claimed in claim 5 which comprises treating the fiber web on a temporary support with a dispersion or solution of binder, applied by a coating knife, by spraying on, or by casting, and releasing the bonded web again from the temporary support after drying.

* * * * *